US006168350B1

(12) United States Patent
Bartlett

(10) Patent No.: US 6,168,350 B1
(45) Date of Patent: Jan. 2, 2001

(54) METHOD AND APPARATUS FOR FORMING ENLARGED PILE HEADS

(75) Inventor: Graham John Bartlett, South Gloucestershire (GB)

(73) Assignee: Kvaerner Cementation Foundations Ltd., Hertfordshire (GB)

( * ) Notice: Under 35 U.S.C. 154(b), the term of this patent shall be extended for 0 days.

(21) Appl. No.: 09/255,728

(22) Filed: Feb. 23, 1999

(30) Foreign Application Priority Data

Feb. 24, 1998 (GB) ..... 9803854

(51) Int. Cl.[7] ..... E02D 5/38

(52) U.S. Cl. ..... 405/240; 405/236; 405/232; 405/253

(58) Field of Search ..... 405/230, 231, 405/232, 233, 236, 237, 238, 240, 241, 244, 253, 255, 256

(56) References Cited

U.S. PATENT DOCUMENTS

| | | | | |
|---|---|---|---|---|
| 2,923,133 | * | 2/1960 | Muller | 405/236 |
| 2,924,948 | * | 2/1960 | Mueller | 405/236 |
| 4,160,613 | * | 7/1979 | Stanwick | 405/244 |
| 5,234,290 | * | 8/1993 | Collins | 405/233 |
| 5,683,207 | * | 11/1997 | Mauer | 405/244 |
| 5,833,399 | * | 11/1998 | Bullivant | 405/233 |

FOREIGN PATENT DOCUMENTS

| | | | | |
|---|---|---|---|---|
| 170503 | * | 2/1986 | (EP) | 405/237 |
| 2284843 | | 6/1995 | (GB) . | |
| 2293850 | | 4/1996 | (GB) . | |
| 9518892 | | 7/1995 | (WO) . | |

* cited by examiner

*Primary Examiner*—Eileen D. Lillis
*Assistant Examiner*—Frederick L. Lagman
(74) *Attorney, Agent, or Firm*—Browdy and Neimark

(57) ABSTRACT

A method of forming a cast-in-situ pile with an enlarged head, wherein a collar (1,13) is releasably affixed to the lower end of a piling tool (10) and the piling tool (10) and the collar (1,13) are driven to a first depth and the collar (1,13) is released from the piling tool (10). The piling tool (10) is then driven to a second depth, the piling tool (10) passing freely through a central aperture (2,14) of the collar (1,13), which remains at the first depth. The piling tool (10) is then withdrawn, and concrete or grout (20) is supplied to the lower end of the piling tool so as to form a cast-in-situ pile (22). When the lower end of the piling tool (10) again reaches the first depth, the collar (1,13) is lifted from the ground and concrete or grout (20) is supplied into the void left thereby so as to form a pile (22) with an enlarged head (23).

19 Claims, 7 Drawing Sheets

METHOD AND APPARATUS FOR FORMING ENLARGED PILE HEADS

BACKGROUND OF THE INVENTION

1. Technical Field of the Invention

The present invention relates to a method and apparatus for forming enlarged pile heads in driven cast-in-situ piling as well as continuous flight auger (CFA) piling techniques.

2. Prior Art

Piles are used in the construction industry to provide foundation support for building and the like. Two common piling techniques are driven cast-in-situ and CFA piling. In driven cast-in-situ piling, a piling tool is driven into the ground to the required depth. The piling tool is then withdrawn, and concrete or grout is concomitantly pumped to the tip of the piling tool so as to fill the underground void left by the tool during withdrawal. In CFA piling, a continuous flight auger is rotated and allowed to penetrate the ground to the required depth. The auger is then withdrawn, with or without rotation, and concrete or grout is pumped to the tip of the auger so as to form a pile in the same manner as described above. CFA piling techniques are discussed in more detail in GB 2 303 868, the disclosure of which is incorporated into the present application by reference.

It is advantageous in some applications for the top, or head, of the resultant pile to have a larger diameter than the main shaft. The ground beam of a building which is to be supported by piles of this sort can be made more efficient than that of a building supported by conventional piles, since the load can be spread over a wider area. This is currently achieved by casting a pile with a straight shaft and subsequently excavating a volume of soil around the head of the pile so as to enable additional concrete to be poured about the head of the pile. In order to obtain the greatest structural integrity, this must be done before the concrete forming the main shaft of the pile has set, which is a difficult and time-consuming task.

OBJECT AND SUMMARY OF THE INVENTION

According to a first aspect of the present invention, there is provided a method of installing a cast-in-situ pile, comprising the steps of:

i) fitting a collar device having a central aperture to a lower end of a piling tool;

ii) penetrating the ground with the piling tool and the collar device for a first period until the collar device has displaced or removed a predetermined surface volume of soil;

iii) disconnecting the collar device from the piling tool and penetrating the ground with the piling tool for a second period until a predetermined depth is reached, the piling tool passing freely through the central aperture of the collar device;

iv) withdrawing the piling tool while concomitantly supplying concrete or grout to the lower end of the piling tool so as to form an underground column of concrete or grout;

v) withdrawing the collar device as the end of the piling tool is withdrawn from the ground, thereby leaving an enlarged diameter void at the surface of the ground while concomitantly supplying concrete or grout to the lower end of the piling tool so as to fill the void with concrete or grout and form an enlarged diameter pile head.

According to a second aspect of the present invention, there is provided a device for forming an enlarged head in a cast-in-situ pile, the device comprising a collar adapted to be releasably fitted to a lower end of a piling tool.

The method and device may be used both with driven cast-in-situ piling techniques and CFA piling techniques. When used with driven cast-in-situ techniques, the collar is advantageously tapered, with the narrower end penetrating the ground first as the piling tool is driven into the ground. This eases the required displacement of the surface volume of soil. For CFA piling applications, the collar is initially rotated with the auger, and is provided with one or more cutting tools on its lower surface which are adapted to cut into the soil. The collar may be tapered, as before, or may have a substantially flat lower surface. The tapered embodiment removes a smaller volume of soil than the flat-surfaced embodiment, and is therefore more economical with concrete, but may be more likely to rise upwards during subsequent excavation of the bore hole in which the eventual pile will be formed.

When used with driven cast-in-situ piling techniques, the collar is initially placed on the ground above the location to be piled, and a drive shoe is located on the ground within the central aperture of the collar. A dolly is placed onto the drive shoe and the collar, and the lower end of a piling tube placed on the dolly. A hammer is then applied to the upper end of the piling tube so as to drive the collar and drive shoe into the ground until the collar has displaced the required surface volume of soil. At this stage, the piling tube is raised and the dolly removed. The piling tube is then lowered again so as to pass freely through the central aperture of the collar and onto the drive shoe, and then hammered to the required depth while the collar stays at the surface of the ground. Once the required depth has been reached, the piling tube is filled with a predetermined volume of concrete or grout and then withdrawn. As the piling tube is withdrawn, the concrete or grout flows out of the lower end of the piling tube so as concomitantly to fill the void left by its withdrawal. As the lower end of the piling tube nears ground level during extraction and concreting, the collar is lifted so as to allow the space from which the surface volume of soil has been displaced to become filled with concrete or grout, thereby forming a pile with an enlarged or "mushroom" head. Advantageously, the volume of concrete or grout initially supplied to the piling tube is calculated so as to be just sufficient to form the shaft and the enlarged head of the cast-in-situ pile. The collar is advantageously provided on its upper surface with a pair of hooks or loops so as to allow the collar to be lifted by a fork-lift truck or the like, or alternatively to which a lifting winch may be attached. A suitable pile reinforcement may then be inserted into the concrete or grout before this has set.

In CFA piling applications, the central aperture of the collar is adapted to fit about the flights of an auger, and the collar is releasably attachable thereto so as to allow the collar to be rotated with the auger. The attachment means may comprise sliders on the collar which are engageable with slots provided on the flight of the auger at its lower end. Alternatively, bolts or clamps or any other suitable and releasable attachment means may be employed. In use, the auger is lowered to the ground through the central aperture of the collar and positioned for excavation. Advantageously, the auger may be rotated for a brief initial period so as to start the excavation. The collar is then connected to the auger by sliding the sliders into the slots on the flight of the auger or by engaging other suitable attachment means, and rotation of the auger and the collar is recommenced until the auger has penetrated a predetermined distance into the ground and the collar has excavated the required surface volume of soil. Once this has been achieved, rotation may be temporarily halted and the collar released from the flight of the auger. Excavation then proceeds to the required depth while the collar remains at the surface of the ground. The auger is then withdrawn, with or without rotation, and concrete or grout is concomitantly supplied to the tip of the auger so as to fill the void thereby created. When the lower end of the auger is brought up to ground level, the slides or other attachment means on the collar are re-engaged with the auger, and the collar is thereby lifted from the ground. The void left by the collar is concomitantly filled with concrete or grout so as to form an enlarged pile head. In order to avoid contamination of the pile head, it is advantageous to clear the excavated soil from the region surround the entry point of the auger into the ground. This may be achieved by any convenient means.

It may also be advantageous to provide a plate or the like for holding the collar in place while excavation of the main bore hole is undertaken. This plate or the like may itself be held in place by a foot or prop extending from the piling rig.

BRIEF DESCRIPTION OF DRAWINGS

For a better understanding of the present invention, and to show how it may be carried into effect, reference shall now be made by way of example to the accompanying drawings, in which.

DETAILED DESCRIPTION OF THE PREFERRED EMBODIMENT(S) OF THE INVENTION

Figure 1:
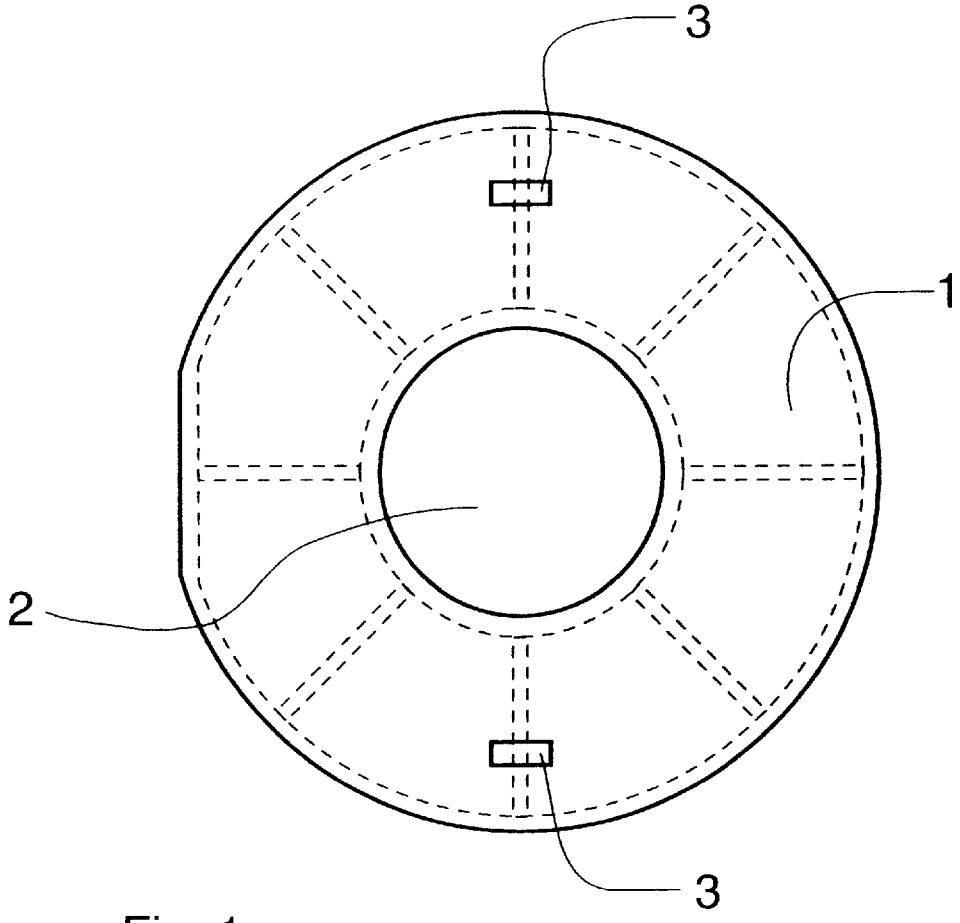
FIG. 1 shows a plan view of a collar device of the present invention for use with driven cast-in-situ piling techniques.
Figure 2:
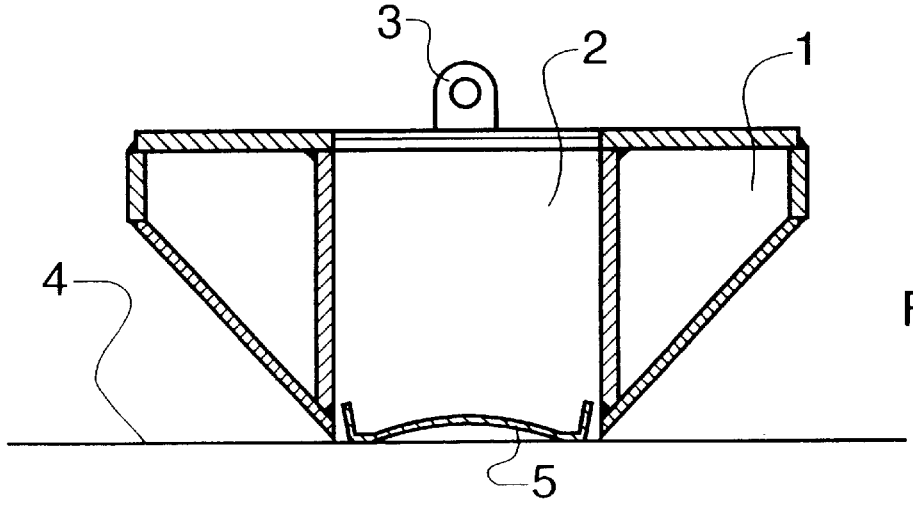
FIG. 2 shows a vertical cross-section through the collar device of FIG. 1.

FIGS. 1 and 2 show a collar device 1 for use with driven cast-in-situ piling techniques. The collar device has a central aperture 2, and is provided with lifting eyes 3. The collar device 1 is generally made of metal, although any substantially rigid material capable of withstanding heavy blows may be used, and has a generally conical configuration. In FIG. 2, the collar device 1 is shown resting on the ground 4 with a drive shoe 5 having been placed on the ground 4 within the central aperture 2.

Figure 3:
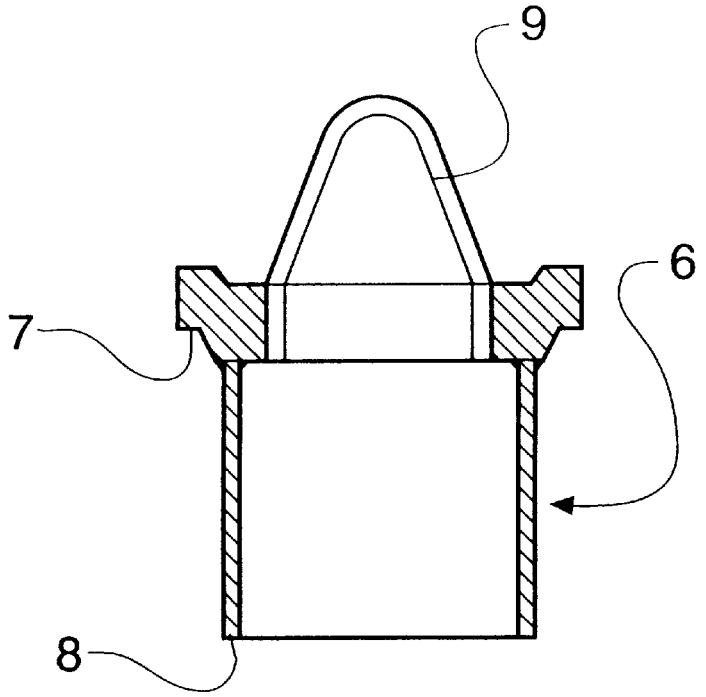
FIG. 3 shows a vertical cross-section through a dolly suitable for use with the collar device of FIGS. 1 and 2.
Figure 4:
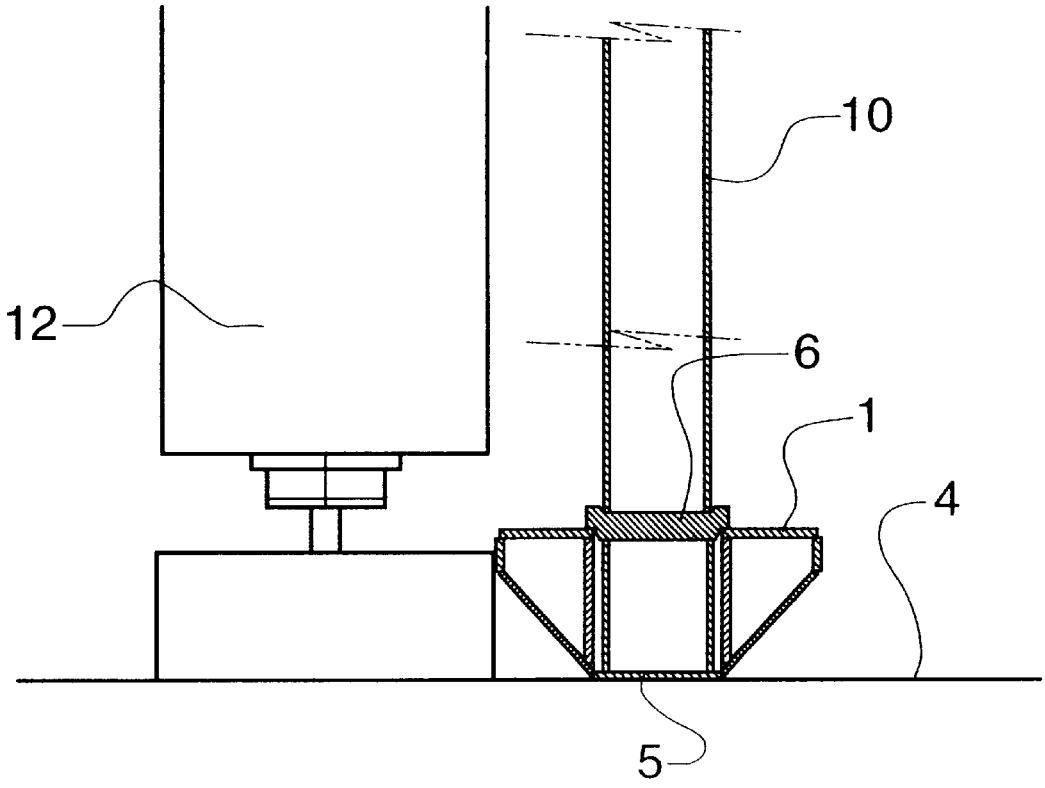
FIG. 4 shows the dolly of FIG. 3 fitted into the collar device of FIGS. 1 and 2.

FIG. 3 shows a dolly 6 which is adapted to fit into the central aperture 2 of the collar device 1. A flange 7 at the upper end of the dolly 6 contacts the top surface of the collar device 1, and the bottom 8 of the dolly 6 contacts the drive shoe 5. This may be seen best in FIG. 4, which shows the collar device 1, the drive shoe 5 and the dolly 6 in position prior to the commencement of a piling operation. The dolly 6 is provided with a lifting bail 9 which drops down inside the dolly 6 when not in use.

Figure 5:
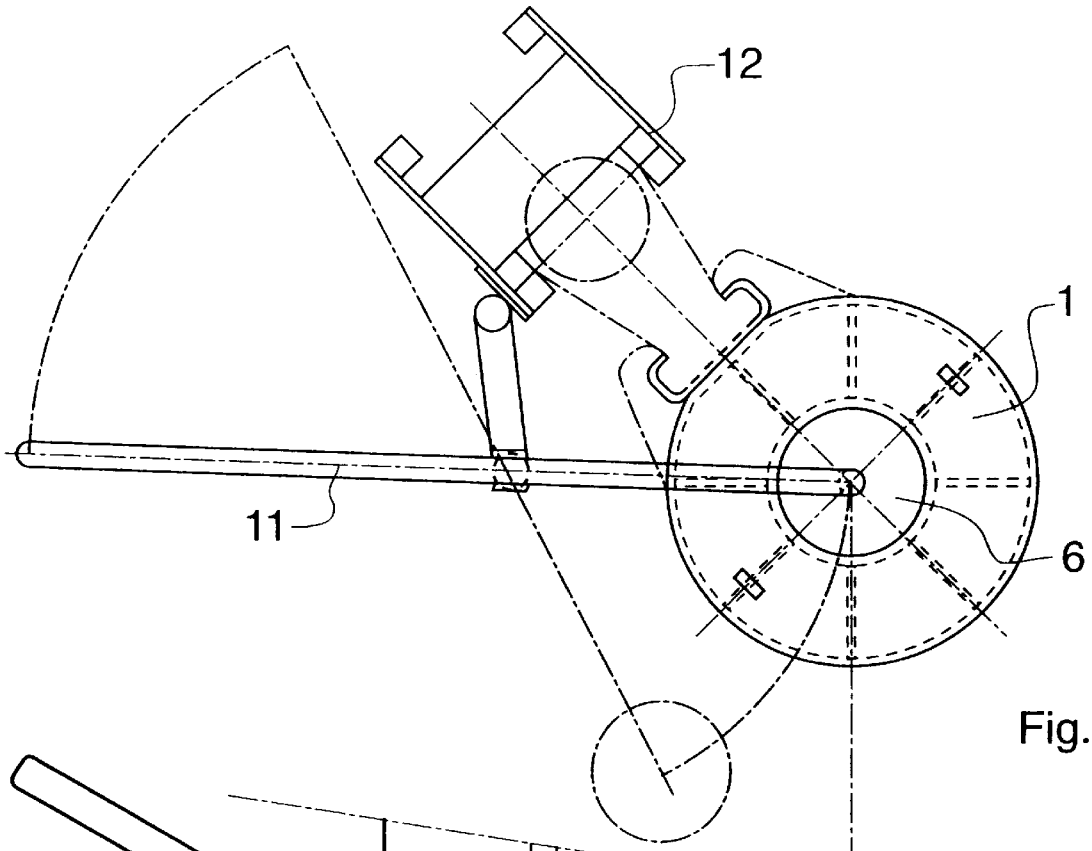
FIG. 5 shows a plan view of a piling rig including a dolly lift arm.
Figure 6:
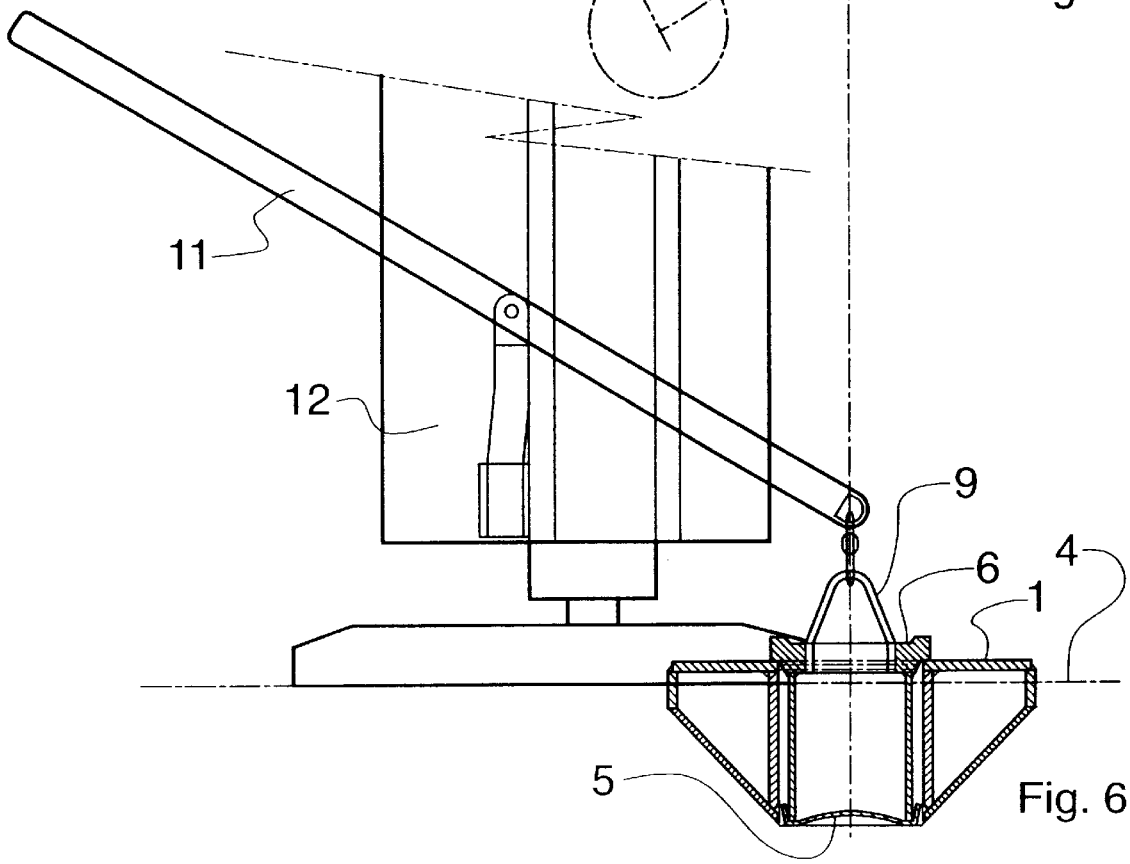
FIG. 6 shows a side elevation of the piling rig of FIG. 5.

A piling tube 10 is then fitted onto the top of the dolly 6, and a hammer or the like (not shown) is used to apply percussive force to the top the piling tube 10, thereby driving the collar device 1, the drive shoe 5 and the dolly 6 into the ground 4. Once the collar device 1 has been pushed into the ground 4 to the required depth, which will generally be when the top surface of the collar device 1 is level with the ground 4, the piling tube 10 is raised and the dolly 6 lifted out of the central aperture 2 of the collar device 1. This may be achieved by way of a lifting arm 11 provided on the piling rig 12, as shown in FIGS. 5 and 6, which hooks onto the lifting bail 9. The lifting arm 11 is also used initially to fit the dolly 6 into the central aperture 2 of the collar device 1.

Figure 7:
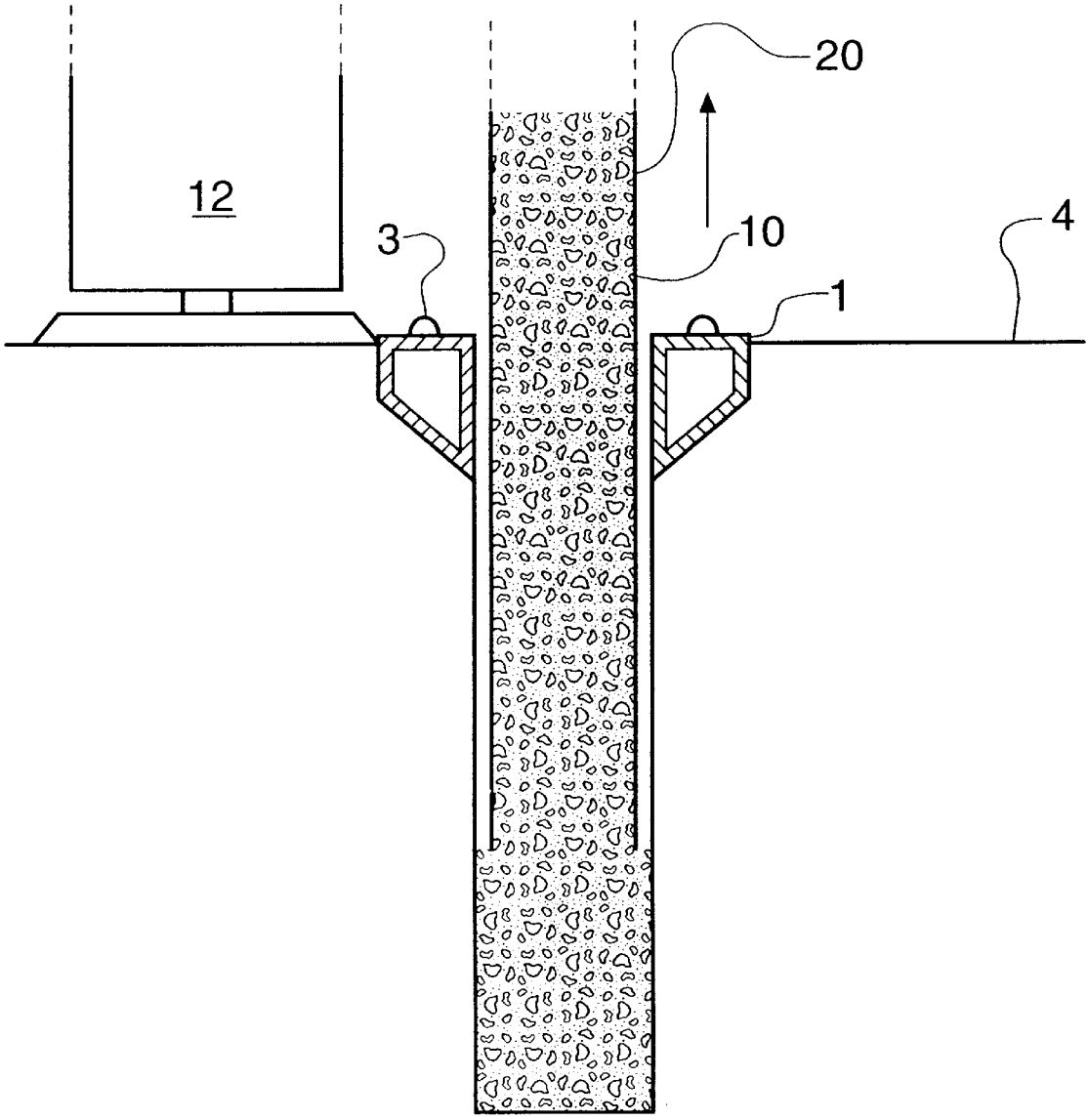
FIG. 7 shows a piling tube being withdrawn from the ground through the central aperture of the collar device of FIGS. 1 and 2.

Once the dolly 6 has been removed, the piling tube 10 is reinserted into the central aperture 2 of the collar device 1 until it contacts the drive shoe 5, and the piling tube 10 and the drive shoe 5 are then driven to the required depth by way of further percussive hammer blows. The piling tube 10 is then filled with a predetermined volume of concrete or grout 20 and withdrawn as shown in FIG. 7, the concrete or grout 20 thereby emerging from the lower end of the piling tube 10 so as to fill the void left by the withdrawal of the piling tube 10.

Figure 8:
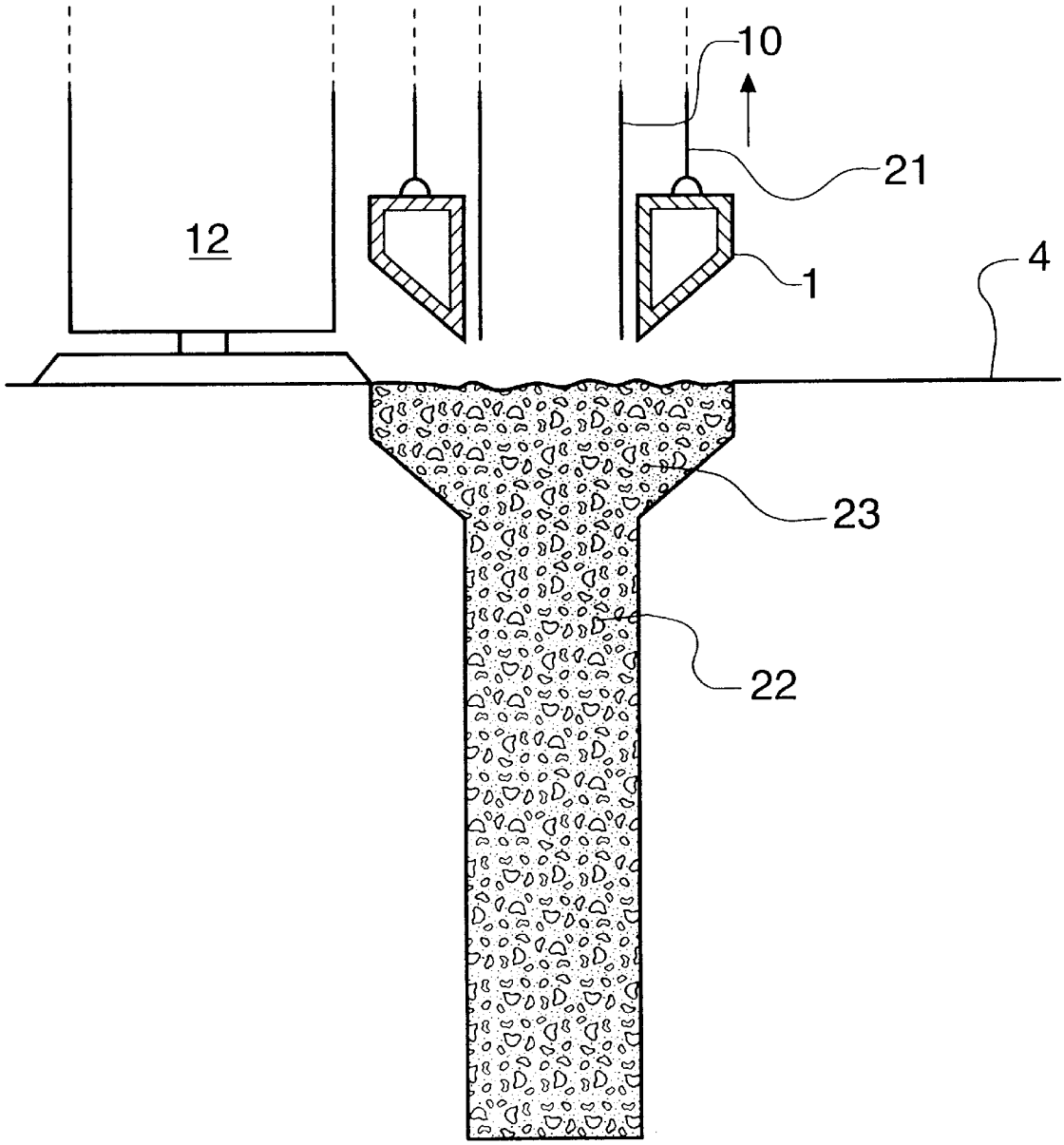
FIG. 8 shows the piling tube and the collar device of FIG. 7 being raised above the ground after formation of a cast-in-situ pile.

Just before the piling tube 10 is completely withdrawn, the collar device 1 is lifted from the ground as shown in FIG. 8. This may be done by way of a line 21 connected to the piling rig 12 or, preferably, by way of a fork-lift truck or the like (not shown), which engages with the lifting eyes 3 on the collar device 1. As the collar device 1 and the piling tube 10 are lifted from the ground 4, concrete or grout 20 is delivered to the void left by the collar device 1 so as to produce a pile 22 with an enlarged head portion 23.

The collar device 1 and the piling rig 12, including the dolly 6, may then be moved to a different location and further piles installed.

Figure 9:
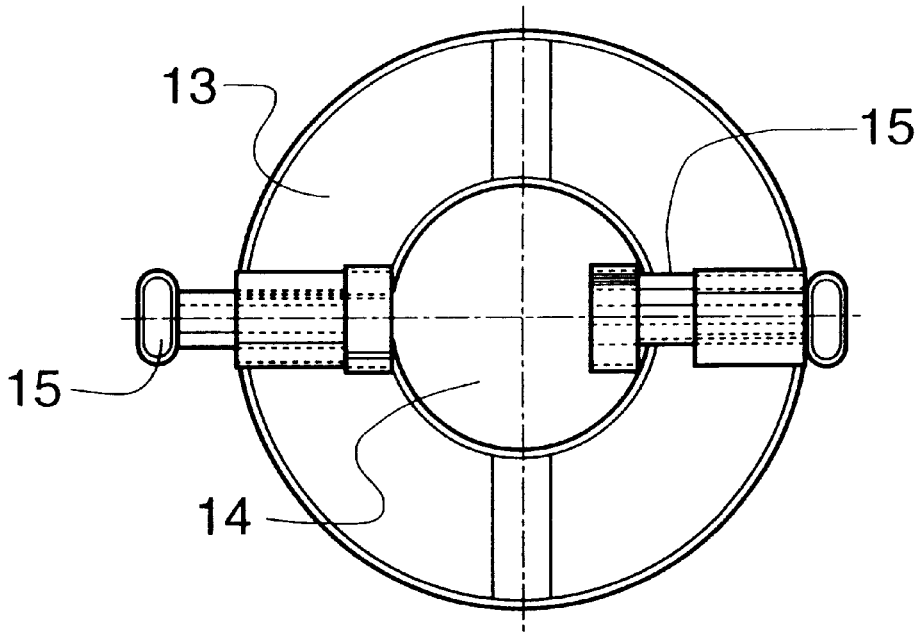
FIG. 9 shows a plan view of a collar device of the present invention for use with CFA piling techniques.
Figure 10:
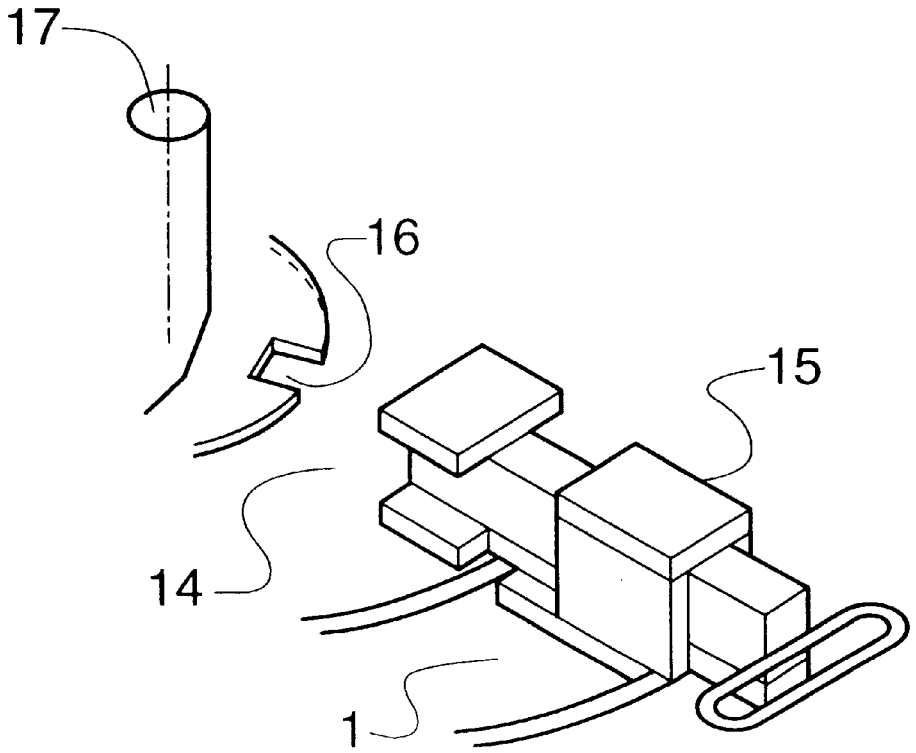
FIG. 10 shows an exploded perspective view of a slide attachment on the collar device of FIG. 9.

A variation of the present invention for use in CFA piling techniques is shown in FIGS. 9 to 12. FIG. 9 shows a collar device 13 having a central aperture 14 and two sliding connectors 15, one of which is shown extended and the other retracted. As shown in FIG. 10, the sliding connectors 15 may be extended so as to engage in slots 16 provided in the flights of an auger 17, which passes through the central aperture 14 of the collar device 13. In this way, the collar device can be releasably attached to the auger 17 so as to rotate and rise and fall therewith.

Figure 11:
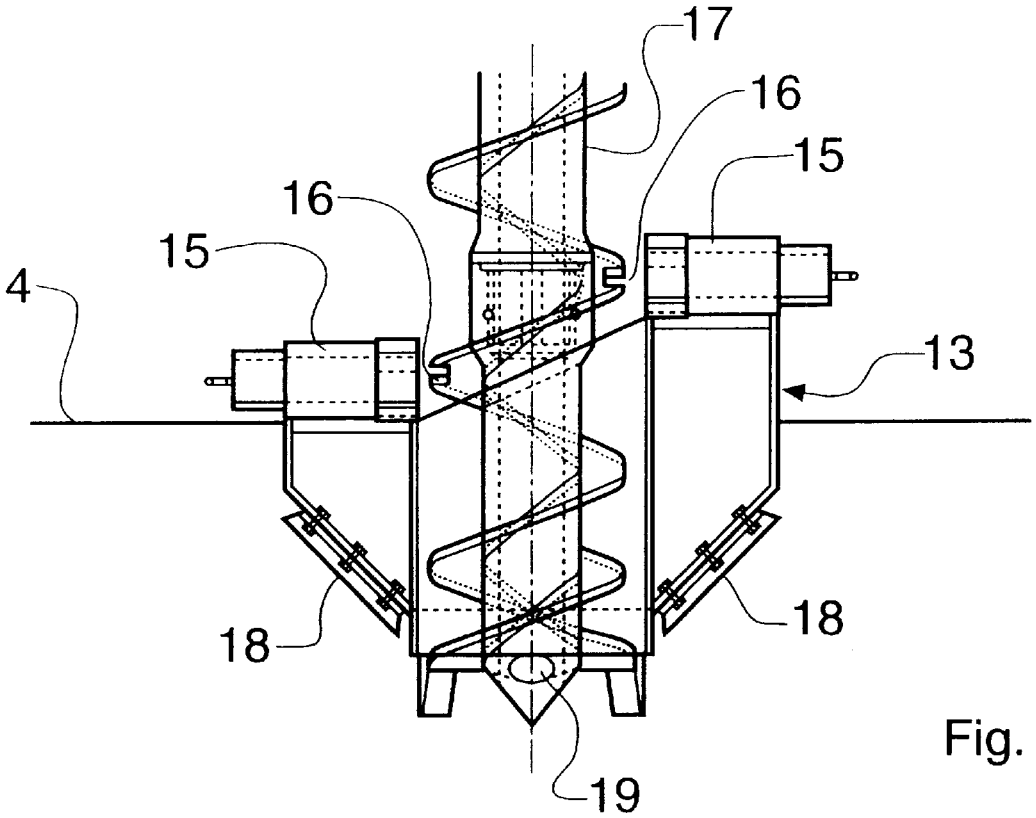
FIG. 11 shows a cross-section through a first embodiment of a collar device of the present invention for use with CFA piling techniques.
Figure 12:
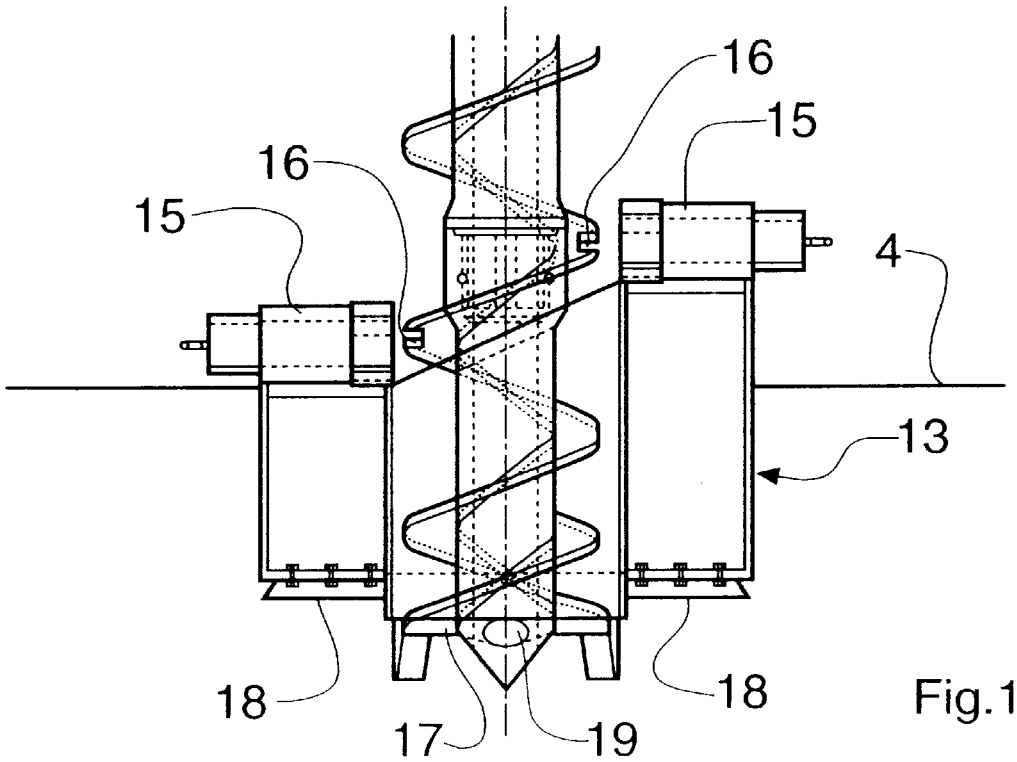
FIG. 12 shows a cross-section through a second embodiment of a collar device of the present invention for use with CFA piling techniques.

As shown in FIGS. 11 and 12, the underside of the collar device 13 is provided with blades 18 which serve to excavate the soil beneath the collar device 13 as the auger 17 and the collar device 13 are rotated. In use, the collar device 13 is coupled to the lower end of the auger 17 as shown, and the auger 17 is rotated and allowed to penetrate the ground 4 together with the collar device 13. Once the main body of the collar device 13 has been sunk into the ground 4, the collar device 13 is decoupled from the auger 17, and the auger 17 is then rotated again until the required excavation depth has been reached. During this operation, the collar device 13 remains in place at ground level, while the auger 17 rotates freely within the central aperture 14.

The auger 17 is then withdrawn, with or without rotation, and concrete or grout is concomitantly pumped to the tip 19 of the auger 17 so as to fill the void left thereby. When the auger 17 has been withdrawn to the level of the collar device 13, the sliding connectors 15 are re-engaged with the slots 16 on the flights of the auger 17, and the collar device is then lifted from the ground 4 by the auger 17. Concrete or grout is concomitantly pumped to the tip 19 of the auger 17 so as to fill the void left by the removal of the collar device 13 and thereby to form a pile with an enlarged head.

The underside of the collar device 13 may be tapered, as shown in FIG. 11, or may be square, as shown in FIG. 12. The tapered embodiment results in less concrete or grout being required, although in some applications the square embodiment may be less likely to rise accidentally out of the ground 4 during excavation.

What is claimed is:

1. A method of installing a cast-in-situ pile, comprising the steps of:

i) fitting a collar device having a central aperture to a lower end of a piling tool;

ii) penetrating the ground with the piling tool and the collar device for a first period until the collar device has displaced or removed a predetermined surface volume of soil;

iii) disconnecting the collar device from the piling tool and penetrating the ground with the piling tool for a second period until a predetermined depth is reached, the piling tool passing freely through the central aperture of the collar device;

iv) withdrawing the piling tool while concomitantly supplying concrete or grout to the lower end of the piling tool so as to form an underground column of concrete or grout;

v) withdrawing the collar device as the end of the piling tool is withdrawn from the ground, thereby leaving an enlarged diameter void at the surface of the ground while concomitantly supplying concrete or grout to the lower end of the piling tool so as to fill the void with concrete or grout and form an enlarged diameter pile head.

2. A method according to claim 1, comprising the further steps of:

i) before step i) of claim 1, placing the collar device on the ground at a predetermined location;

ii) thereafter, placing a drive shoe on the ground within the central aperture;

iii) thereafter, placing a dolly within the central aperture so as to contact the drive shoe, the dolly having a flange to engage an upper surface of the collar device;

iv) thereafter, engaging the piling tube to the dolly;

v) during step ii) of claim 1, applying percussive blows to the piling tube so as to drive the collar device, the drive shoe the dolly to a first level;

vi) after step iii) of claim 1, raising the piling tube and removing the dolly;

vii) thereafter, lowering the piling tube so as to contact the drive shoe through the central aperture of the collar device; and viii) thereafter, applying further percussive blows to the piling tube so as to drive the shoe to a second level, the piling tube passing freely through the central aperture of the collar device.

3. A method according to claim 1, comprising the further step of:

positioning and withdrawing the collar device by way of a fork-lift truck.

4. A method according to claim 3, further comprising the step of:

pressing the collar device down during steps v) and vi) by way of a plate.

5. A method of installing a cast-in-situ pile, comprising the steps of:

i) fitting a collar device having a central aperture about the end of a continuous flight auger;

ii) releasably affixing the collar device to the auger;

iii) rotating the auger and the collar device and allowing both to penetrate the ground to a first level;

iv) releasing the collar device from the auger;

v) further rotating the auger so as to penetrate the ground to a second level, the auger passing freely through the central aperture of the collar device;

vi) withdrawing the auger while concomitantly supplying concrete or grout to the lower end of the auger so as to form an underground column of concrete or grout;

vii) reaffixing the collar device to the auger when the end of the auger is again level with the collar device and lifting the collar device with the auger, thereby leaving an enlarged diameter void at the surface of the ground while concomitantly supplying concrete or grout to the lower end of the auger so as to fill the void with concrete or grout and form an enlarged diameter pile head.

6. A device for forming an enlarged head in a cast-in-situ pile, the device comprising a collar adapted to be releasably fitted to a lower end of a piling tool, wherein an underside of the collar device is provided with one or more cutting tools.

7. A device as claimed in claim 6, wherein the collar is tapered.

8. A device as claimed in claim 7, wherein the collar has a generally conical configuration.

9. A device as claimed in claim 8, wherein the collar includes attachment means adapted to releasably affix the collar about a continuous flight auger.

10. A device as claimed in claim 9, wherein the attachment means is in the form of one or more sliders adapted to engage with recesses provided in the auger flight.

11. A device as claimed in claim 7, wherein the collar includes attachment means adapted to releasably affix the collar about a continuous flight auger.

12. A device as claimed in claim 11, wherein the attachment means is in the form of one or more sliders adapted to engage with the the recesses provided in the auger flight.

13. A device as claimed in claim 6, wherein the collar includes attachment means adapted to releasably affix the collar about a continuous flight auger.

14. A device as claimed in claim 13, wherein the attachment means is in the form of one or more sliders adapted to engage with recesses provided in the auger flight.

15. A device as claimed in claim 14, wherein the underside of the collar device is tapered.

16. A device as claimed in claim 14, wherein the underside of the collar device is generally square.

17. A device as claimed in claim 13, wherein the underside of the collar device is tapered.

18. A device as claimed in claim 13, wherein the underside of the collar device is generally square.

19. A device as claimed in claim 6, wherein the underside of the collar device is generally square.

* * * * *